US005491311A

United States Patent [19]

Muscat et al.

[11] Patent Number: 5,491,311

[45] Date of Patent: Feb. 13, 1996

[54] MULTIFUNCTION SWITCH

[75] Inventors: Orlando F. Muscat, Novi; Robert D. Muller, Royal Oak; Mark Feldman, Farmington Hills, all of Mich.

[73] Assignee: United Technologies Automotive, Inc., Dearborn, Mich.

[21] Appl. No.: 149,667

[22] Filed: Nov. 8, 1993

[51] Int. Cl.[6] ..... H01H 9/00

[52] U.S. Cl. ..... 200/4; 200/5 R

[58] Field of Search ..... 200/4, 5 R, 6 R, 200/7, 8 R, 8 A, 11 R, 14, 11 A, 11 D, 11 DA, 11 E, 11 G, 11 J, 11 K, 11 TW, 16 R, 16 A, 16 C, 16 D, 17 R, 18, 61.54

[56] References Cited

U.S. PATENT DOCUMENTS 2,381,688 8/1945 Reiff ..... 200/6

5,281,779 1/1994 Bogoukan et al. ..... 200/5 R

*Primary Examiner*—Kristine L. Kincaid
*Assistant Examiner*—Michael A. Friedhofer
*Attorney, Agent, or Firm*—Harness, Dickey & Pierce

[57] ABSTRACT

A bi-directional multifunction switch which incorporates a single contact carrier having conductive contacts adapted to be moved in various directions as a result of rotary and push/pull actuation of an interconnected knob. Electrically conductive circuit paths formed in a substrate surface are contacted by protrusions on the conductive contacts to accomplish electrical switching functions. The contact carrier is moved via a shaft which securely retains the contact carrier along opposing axes and which moves as a result of turning, pushing or pulling the actuating knob.

16 Claims, 4 Drawing Sheets

MULTIFUNCTION SWITCH

BACKGROUND OF THE INVENTION

The present invention relates generally to electrical switches and, more particularly, to a bi-directional multifunction electrical switch which utilizes a single contact carrier.

Single knob electrical switches, with both rotary and push/pull actuation capabilities, are relatively common, especially in the automotive field. One primary example is a vehicle headlamp switch which enables the driver to turn the-vehicle's headlights on and off by pushing in and pulling out the knob, and which also enables the driver to dim the vehicle's interior lights, typically on when the headlights are on, via rotary actuation of the knob. This type of switch utilizes conductive contacts which are moved across conductive circuit paths as a result of turning, pushing in or pulling out the knob. The push/pull motion may occur entirely independently of rotation or the knob may be rotated into the in and out positions.

Conventional switches of this type, however, often utilize separate switch mechanisms, each moved with either the rotary or the push/pull actuating motions. This often necessitates separate switching elements and thereby leads to manufacturing difficulties, increased assembly costs and increased piece costs. In addition, reliability is usually decreased with an increased number of separately moving parts. Finally, separate switching element parts usually require more space. This can be a problem, especially in the automotive industry, as there is an ever increasing effort to reduce the size of this and other types of switches, especially those placed in the vehicle dash panel. As a result, switch designers are being given ever decreasing design envelopes within which to provide a reliable and functional switch.

There is therefore a continuing need for electrical switches having both rotary and push/pull actuation capabilities which are simple and manufacturable as well as low cost and reliable.

SUMMARY OF THE INVENTION

The present invention provides an improved switch of this type which incorporates a single contact carrier having electrically conductive contacts adapted to be moved in various directions as a result of a rotary and push/pull actuation of an interconnected knob. Electrically conductive circuit paths are formed on a substrate surface and are contacted by the conductive contacts to accomplish electrical switching functions. The contact carrier is moved via a shaft which securely retains the contact carrier and which moves both rotationally and linearly along the axis of rotation as a result of turning, pushing or pulling the actuating knob.

Additional advantages and features of the present invention will become apparent from the subsequent description and the appended claims, taken in conjunction with the accompanying drawings.

DETAILED DESCRIPTION OF A PREFERRED EMBODIMENT

Figure 1:
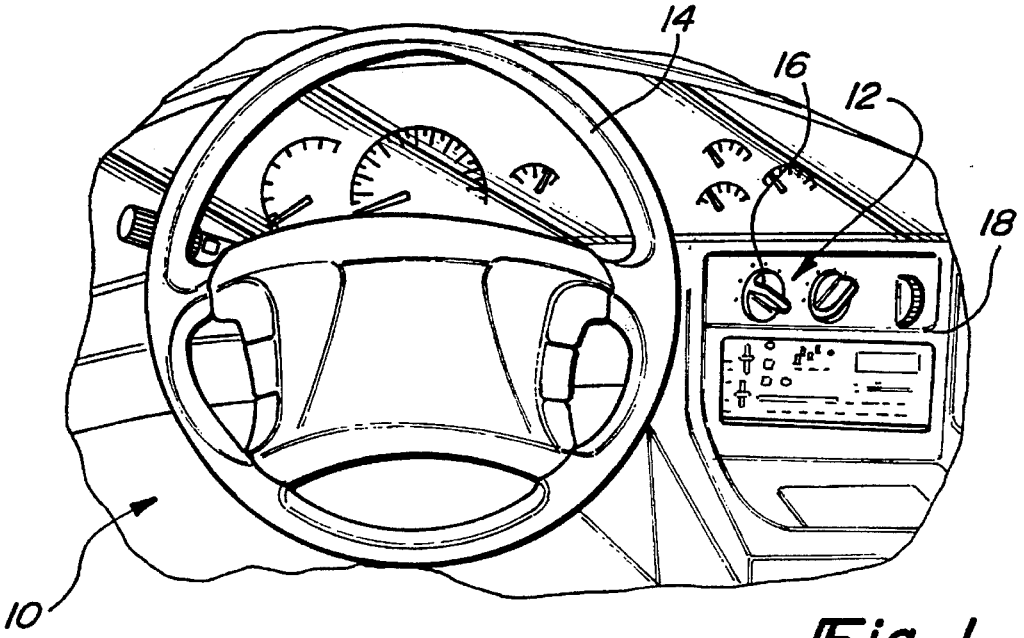
FIG. 1 is a front elevational view of a vehicle dash panel having a switch mechanism according to the present invention mounted therein.

Referring now to the drawings, FIG. 1 illustrates a dashboard portion 10 of a vehicle having mounted therein a switch mechanism 12 of the present invention, adjacent the vehicle steering wheel 14. As shown in the figure, switch 12 includes at least one actuating knob 16, capable of both rotational and push/pull actuation. Knob 16 fits within a face plate 18 which fits into a corresponding aperture in dash 10 and is preferably contoured so as to lie flush therewith. Knob 16 and face plate 18 may be made of a transparent material, typically a plastic, in order to facilitate backlighting of portions thereof.

Figure 2:
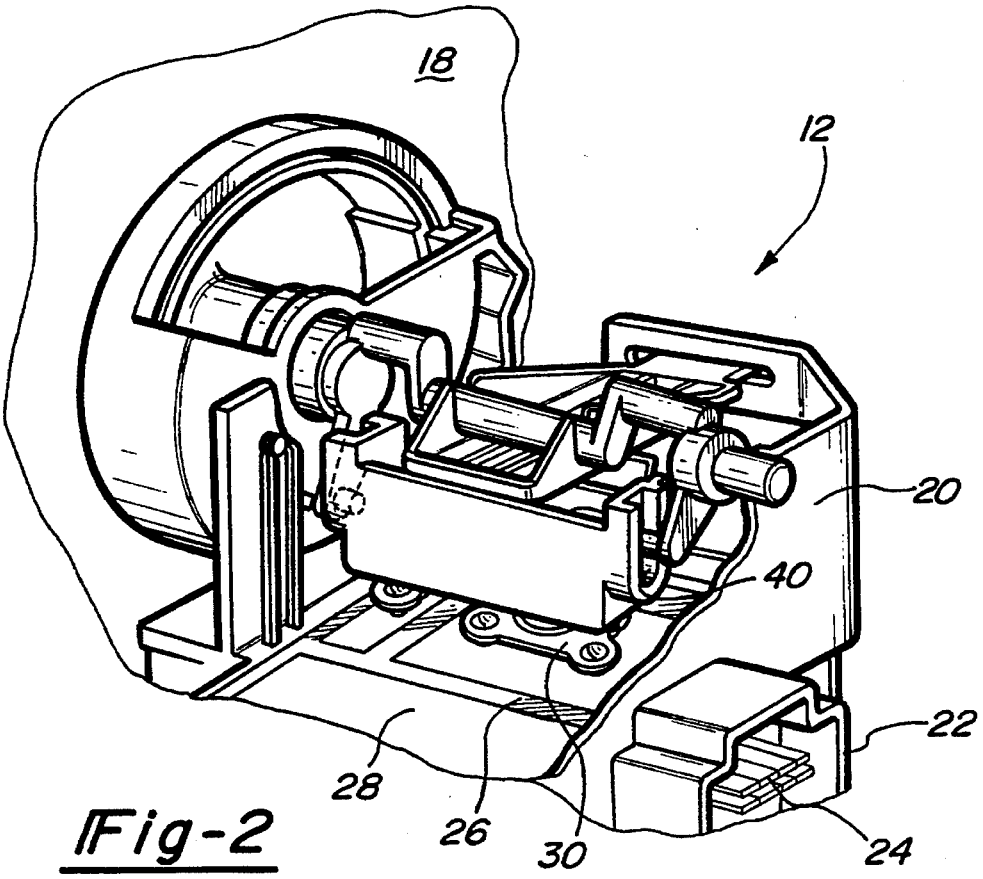
FIG. 2 is a perspective view from behind the dash, of the present switch mechanism.

As shown in FIG. 2, the interior surface of face plate 18 has attached thereto the switch mechanism 12 of the present invention. Face plate 18 also has attached thereto a protective enclosing housing 20, shown partially broken away, for switch 12 which substantially supports switch mechanism 12 from beneath. Housing 20 is preferably formed of a hard plastic, polymeric or other rigid nonconductive material and has attached thereto or formed therein, at least one connector guide 22 for use in physically and electrically connecting switch mechanism 12 to the vehicle's electrical system via a mating connector and adjoined cable (not shown). This electrical connection may be made in any one of a number of methods, but in this exemplary embodiment is made using an array of copper contact strips 24 which project outwardly from housing 20 through the center of surrounding guide 22.

Contact strips 24 also project into housing 20 and are electrically connected to a series of interconnected electrically conductive traces or paths 26 which have been formed on a suitable supporting surface or substrate 28. Paths 26 may be formed of any suitable conductive material such as a metal or alloy printed on a supporting circuit board substrate or may be made of copper strips or other suitable metallic or other conductive material insert molded in a plastic, polymer or resin. In this preferred embodiment, paths 26 are formed of copper strips which have been insert molded into a plastic substrate 28 which also serves as a bottom part of housing 20. Paths 26 are configured so as to switch the flow of electric current by opening and closing circuit paths or combinations of paths, caused by the placement thereon of electrical contacts 30. Contacts 30 are predeterminately moved across the surface of paths 26 in order to electrically make and break circuit paths formed therebetween and thereby selectively direct current flow to contact strips 24 and onto the electrical components controlled thereby, in the present embodiment the vehicle's headlamps.

Figure 3:
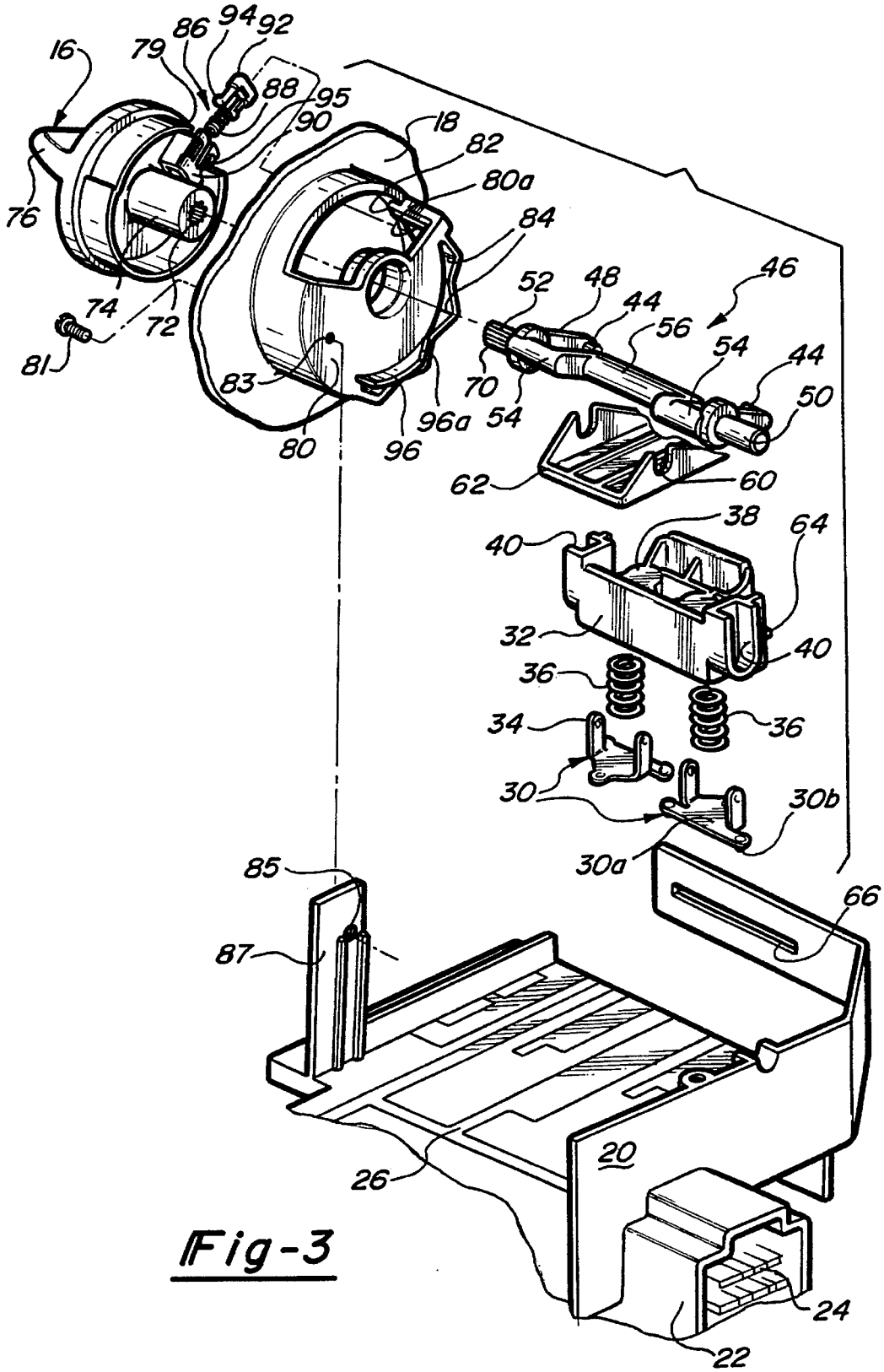
FIG. 3 is an exploded perspective view of the switch mechanism illustrated in FIG. 2.

The contacts 30 are preferably formed of copper or other suitable metallic or conductive material. As shown in FIG. 3 contact 30 are supported by a contact carrier 32, such as by tabs 34 secured to carrier 32 in any suitable manner such as interference press fit. Contacts 30 are spring loaded or biased away from carrier 32, and therefore toward engagement with paths 26, by a biasing means such as an appropriately fashioned spring 36 held in compression between an upper surface 30*a* of contact 30 and an inside surface of a substantially cylindrical interior depression 38 formed in carrier 32. Contact carrier 32 also preferably has formed therein, on opposing sides thereof, a U-shaped slot 40 adapted to retain therein an inwardly projecting lug 44 of an actuating shaft 46.

Lugs 44 project at a substantially right angle from a substantially vertical portion 48 of shaft 46. Each vertical portion 48 has projecting outwardly therefrom one of rods 50 and 52. Projecting orthogonally inwardly from each portion 48, in a direction opposite rods 50 and 52, is an offset shaft portion 54. Shaft portions 54 have connected therebetween a center shaft portion 56, preferably positioned on vertical portions 48 with respect to offset portions 54 so as to be axially aligned with rods 50 and 52. Alternately, however, shaft portions 54 need not be offset from the axis of center portion 56, and depending upon the particular configuration of the switch, all three portions of shaft 46 intermediate vertical portions 48 could be colinear. All portions of shaft 46 may also be integrally formed, preferably out of aluminum or other suitable material.

Still referring to FIG. 3, section 56 of shaft 46 is pivotally supported from beneath by U-shaped slots 60 formed in a support bracket 62. Preferably, a suitably fashioned portion of housing 20 such as a flange or partition (not shown) contacts shaft center section 56 from above, thereby retaining section 56 in slots 60. Bracket 62 is positioned over contact carrier 32 so as to be able to rest thereon and thereby holds carrier 32 down against springs 36. Bracket 62 is held in place via a projecting fin 64 (shown best in FIGS. 4–6) which is retained in a corresponding rectangular slot 66 formed in a side of housing 20.

Rod 52 of shaft 46 has formed therein a series of radially positioned splines 70 which frictionally engage a corresponding splined opening 72 in a shaft 74 formed on knob 16 opposite a handle 76. The engagement of splines 70 and 72 enable rotational movement of shaft 46 as a result of rotation of knob 16. An inner cylindrical portion 78 of knob 16 preferably is retained in a suitably formed casing 80 attached or formed as part of face plate 18. Casing 80 is preferably attached to housing 20 via a suitable fastener 81 passing through holes 83 and 85 in casing 80 and in an upstanding flange 87 of housing 20, respectively. Casing 80 may also include a cutout portion 82 to facilitate backlighting of knob 16, as well as a series of generally angular projections 84 which cooperate with a projecting arm 86 of knob 16 to form a detent mechanism.

Arm 86 is biased against an inner surface 80*a* of casing 80 and formed by a spring 88 compressed within a hollow cylindrical portion 90 formed off of shaft 74 and a retainer 92. Retainer 92 preferably has a bulbous head 92*a*, adapted to protrude through an opening 79 in cylinder 78, and opposing barbed tangs 94 which engage suitable opposing apertures 95 formed in the sides of cylindrical portion 90. This configuration thereby biases retainer 92 against inside surface 80*a* of cylindrical casing 80, requiring a slight increase in rotational force to be exerted on knob 16 to overcome seating of retainer 92 in detent projections 84.

Figure 4:
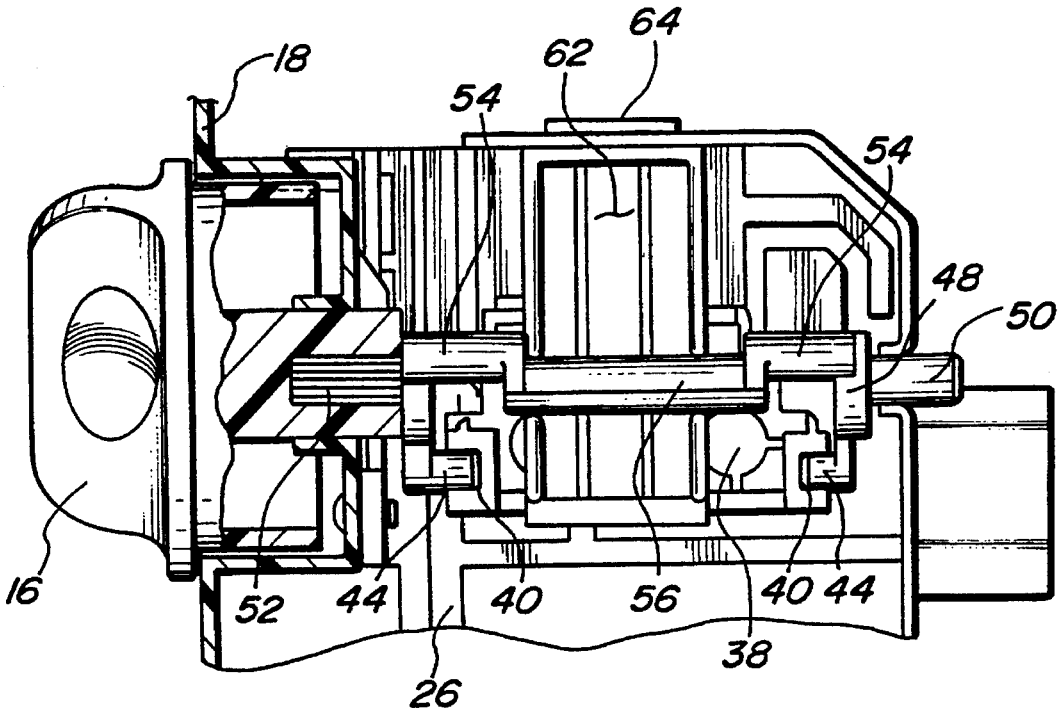
FIG. 4 is a plan view, partially in cross section, of the present switch mechanism in a first position.
Figure 5:
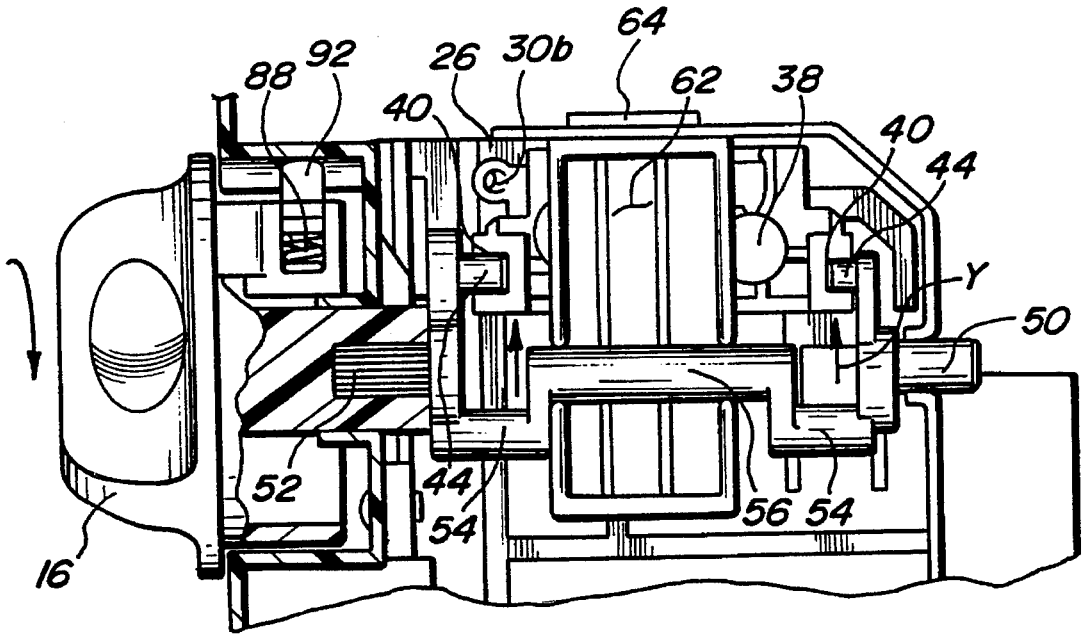
FIG. 5 is a view similar to FIG. 4 wherein the switch mechanism is shown in a second rotated position.

As shown more clearly in FIGS. 4–5, rotational actuation of knob 16, substantially between the detented positions created by projecting portions 84 and spring loaded arm 86, causes rotation of shaft 46 and resultant movement of contact carrier 32. This further results in movement of contacts 30, specifically a series of outwardly projecting contact protrusions 30*b*, along circuit paths 26 to thereby effect electrical switching. This rotational actuation of knob 16 causes substantially linear movement of contacts 30 in a first direction Y.

Figure 6:
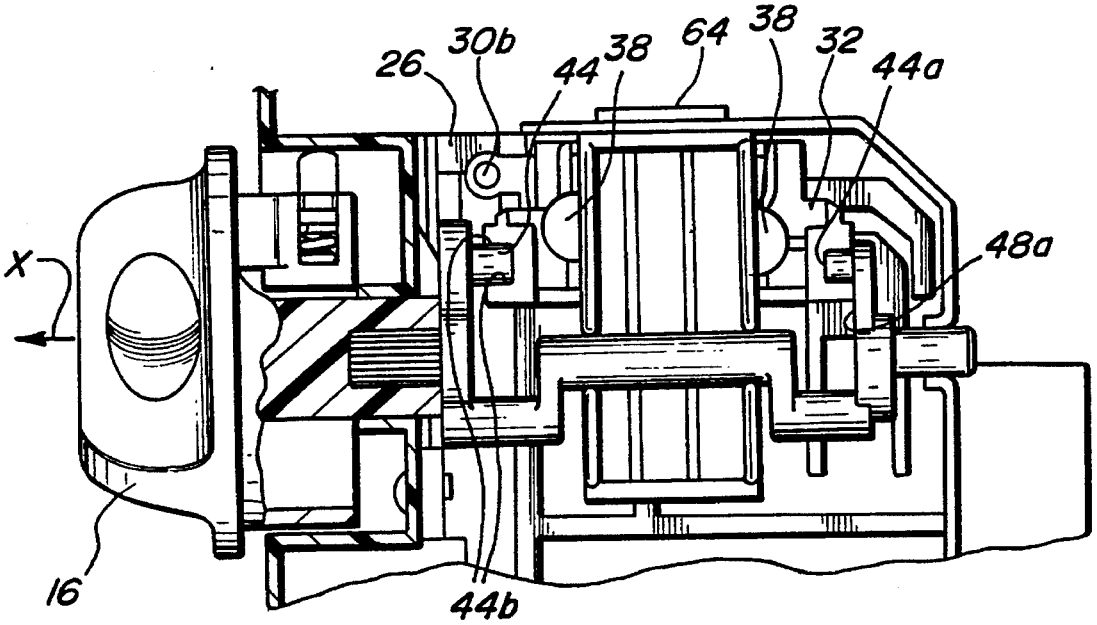
FIG. 6 is a view similar to FIGS. 4 and 5, of the present switch mechanism in a pulled out position.

Knob 16 can also be pulled out away from face plate 18, as shown in FIG. 6, to move contacts 30 in a direction X, which is generally orthogonal to direction Y. This movement of knob 16 is facilitated by a ramped surface 96*a* of an upstanding projection 96 of casing 80, against which vertical section 48 of shaft 46 adjacent rod 52 bears. As vertical section 48 moves off of and clears projection 96, a pulling motion of knob 16 is created. Opposing rotational movement of vertical section 48 upwardly onto and along ramped surface 96*a* results in knob 16 being pushed inwardly.

Shaft 46 thereby can be moved rotationally as well as linearly along its axis of rotation. To further facilitate this motion, slot 66 in housing 20 is made longer than fin 64 of bracket 62 so as to also allow fin 64 to slide in slot 66. While the present embodiment of switch mechanism 12 allows push/pull motion at only a single rotational position of knob 16, it should be appreciated that push/pull capability at each detented position of the switch would also be possible with only slight reconfiguration, namely the creation of multiple recesses in projecting surface 96.

Figure 7:
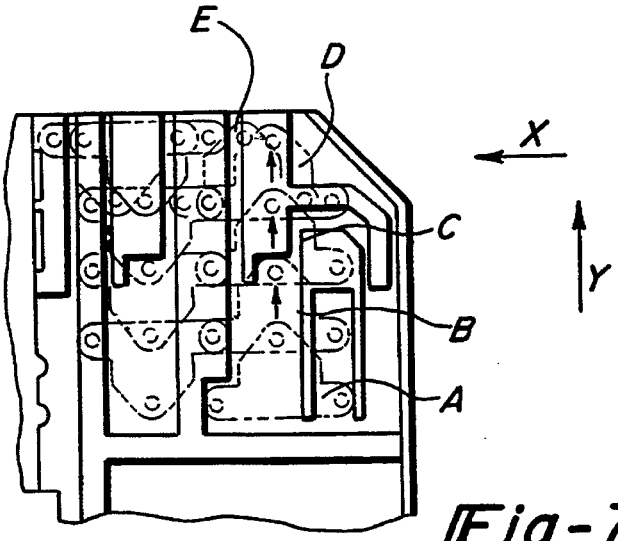
FIG. 7 is a plan view which illustrates the positioning of the contacts and contact carrier with respect to the conductive switching paths, with the switch mechanism in various switch positions.

In order to best facilitate effective electrical contact between contacts 30 and paths 26, contact protrusions 30*b* which electrically engage paths 26 are preferably made spherical in shape so as to readily be moved in different directions. This movement is illustrated in FIG. 7 wherein each set of contacts 30 is shown moving to four positions, A–D, in the Y direction and to one position, E, in the X direction. The engagement of lugs 44 in U-shaped slots 40 allow contact carrier 32 to be securely retained thereby when moved in either of these orthogonal directions. More specifically, as shown in FIG. 6, surface 44*a* of each lug 44, in cooperation with surface 48*a* of each vertical member 48, is forced against opposing surfaces of carrier 32 when knob 16 is pushed in and pulled out. Similarly, cylindrical surface portions 44*b* of each lug 44 engage opposing side surfaces within U-shaped slots 40 formed in carrier 32 during rotation of knob 16 and the resultant movement of contact carrier 32 in the Y direction.

This configuration of switch mechanism 12 thereby requires a minimum number of parts for bidirectional switch actuation by allowing use of a single contact carrier with multiple contacts for both motions. Perpendicular portions of the rotating shaft effectively grip the contact carrier to create reliable contact motion in orthogonal directions. Moreover, a reduction in the number of parts previously utilized to perform the same function results in simpler assembly processes, lower cost and increased reliability. This configuration also allows the switch mechanism to have a smaller physical space requirement than more conventional switch mechanisms of this type.

The foregoing discussion discloses and describes merely exemplary embodiments of the present invention. One skilled in the art will readily recognize from such discussion, and from the accompanying drawings and claims, that various changes and modifications can be made therein without departing from the spirit and scope of the invention as defined in the following claims.

What is claimed is:

1. A switch mechanism comprising:

an actuating knob adapted to be moved in rotational and in and out directions;

a shaft operably coupled to said knob and adapted to be moved thereby;

a single contact carrier mounted to said shaft and adapted to be moved therewith, said contact carrier having mounted thereto at least two electrically conductive contacts; and at least two circuit paths formed on a substrate surface, said electrically conductive contacts being moved along said surface in orthogonal directions into and out of electrical engagement with said circuit paths to effect electrical switching.

2. The switch mechanism of claim 1 further comprising biasing means connected between at least one of said contacts and said contact carrier for biasing said at least one of said contacts away from said contact carrier and toward said substrate surface.

3. The switch mechanism of claim 2 wherein said biasing means includes a spring.

4. The switch mechanism of claim 2 further comprising means for biasing said contact carrier downwardly against said contact biasing means.

5. The switch mechanism of claim 1 wherein said circuit paths in said surface are formed as a printed circuit.

6. The switch mechanism of claim 1 wherein said circuit paths in said surface are formed as a plurality of conductive metal strips insert molded into said substrate surface.

7. The switch mechanism of claim 6 further comprising a protective enclosing housing wherein said substrate surface is formed as a surface of said housing.

8. The switch mechanism of claim 1 further comprising a detent mechanism in cooperation with said actuating knob to provide a detent of said switch mechanism at a plurality of rotational positions of said actuating knob.

9. The switch mechanism of claim 8, further comprising a cylindrical casing rotatably connected to a housing for retaining a portion of said actuating knob.

10. The switch mechanism of claim 9 wherein said detent mechanism includes a spring loaded arm adapted to slidingly engage an inside surface of said cylindrical casing, said rotational positions created by outward projections in said casing into which said spring loaded arm seats.

11. The switch mechanism of claim 10 wherein said casing further includes an outwardly projecting ramped surface adapted to be engaged by a portion of said shaft, said shaft portion moving onto and off of said ramped surface to create said in and out motion of said actuating knob.

12. The switch mechanism of claim 1 wherein at least one of said electrically conductive contacts has at least one spherically shaped protrusion adapted to electrically engage said circuit paths.

13. The switch mechanism of claim 1 wherein said shaft is operably coupled to said knob by a series of engaging splines.

14. The switch mechanism of claim 1 wherein said shaft includes a pair of transversely extending portions adapted to retain said contact carrier therebetween.

15. The switch mechanism of claim 14 wherein said shaft further includes a pair of lugs, each lug extending inwardly from one of said transversely extending portions, each lug engaging a generally U-shaped slot formed in a side of said contact carrier.

16. A vehicle electrical switch mechanism comprising:

an actuating knob adapted to be moved in rotational and in and out directions;

a shaft operably coupled to said knob by a splined connection, said shaft adapted to rotate with rotational movement of said knob, said shaft moving linearly along an axis of said rotation with said in and out motion of said actuating knob;

a single contact carrier mounted to said shaft and adapted to be moved therewith, said contact carrier having mounted thereto at least one electrically conductive contact having at least one spherically shaped protrusion;

at least two circuit paths formed on a substrate surface, said protrusion of said contact being moved along said surface in orthogonal directions into and out of electrical engagement with said circuit paths to effect electrical switching;

biasing means connected between said contact and said contact carrier for biasing said electrically conductive contact away from said contact carrier and toward said substrate surface;

a detent mechanism in cooperation with said actuating knob to provide a detent of said switch mechanism at a plurality of rotational positions of said actuating knob, said detent mechanism including a spring loaded arm adapted to slidingly engage an inside surface of a cylindrical casing, said rotational positions created by outward projections in said casing into which said spring loaded arm seats; and a ramped surface formed on said casing and adapted to be engaged by a portion of said shaft, said shaft portion moving into and out of engagement with said ramped surface to create said pushing in and pulling out motions of said actuating knob.

* * * * *

UNITED STATES PATENT AND TRADEMARK OFFICE

CERTIFICATE OF CORRECTION

PATENT NO. : 5,491,311

DATED : February 13, 1996

INVENTOR(S) : Orlando F. Muscat et al

It is certified that error appears in the above-indentified patent and that said Letters Patent is hereby corrected as shown below:

Column 2, line 67, "contact", first occurrence should be --contacts--;

Column 3, line 26, insert --center-- before "section";

Column 3, line 62, "4-5" should be --3-5--;

Column 6, line 45, claim 16, delete "pushing";

Column 6, line 45, claim 16, delete "pulling".

Signed and Sealed this

Twenty-seventh Day of August, 1996

*Attest:*

Bruce Lehman

BRUCE LEHMAN

*Attesting Officer*

*Commissioner of Patents and Trademarks*